US012298011B2

(12) United States Patent
Wolterink et al.

(10) Patent No.: US 12,298,011 B2
(45) Date of Patent: May 13, 2025

(54) COOKING SYSTEM FOR A SPACE RESTRICTED ENVIRONMENT, A SELF-CONTAINED COOKING UNIT FOR THE COOKING SYSTEM AND RELATED METHOD OF OPERATING A COOKING SYSTEM WITHIN A SPACE RESTRICTED ENVIRONMENT

(71) Applicant: Thetford BV, Etten-Leur (NL)

(72) Inventors: Kevin Wolterink, Breda (NL); Martin Jordan, Sheffield (GB); Mohammad Musameh, Pontefract (GB); Simon Scott Jenkins, Sheffield (GB); Victor Haans, Rotterdam (NL); Yannick Maaskant, Heerjansdam (NL)

(73) Assignee: Thetford BV, Etten-Leur (NL)

( * ) Notice: Subject to any disclaimer, the term of this patent is extended or adjusted under 35 U.S.C. 154(b) by 743 days.

(21) Appl. No.: 17/434,566

(22) PCT Filed: Feb. 20, 2020

(86) PCT No.: PCT/IB2020/051436
§ 371 (c)(1),
(2) Date: Aug. 27, 2021

(87) PCT Pub. No.: WO2020/174329
PCT Pub. Date: Sep. 3, 2020

(65) Prior Publication Data

US 2022/0136709 A1 May 5, 2022

Related U.S. Application Data

(60) Provisional application No. 62/811,584, filed on Feb. 28, 2019.

(51) Int. Cl.
*F24C 15/30* (2006.01)
*F24C 15/10* (2006.01)
*F24C 15/20* (2006.01)

(52) U.S. Cl.
CPC ..... *F24C 15/30* (2013.01); *F24C 15/103* (2013.01); *F24C 15/2042* (2013.01); *F24C 15/2092* (2013.01)

(58) Field of Classification Search
CPC .... F24C 15/30; F24C 15/103; F24C 15/2042; F24C 15/2092
(Continued)

(56) References Cited

U.S. PATENT DOCUMENTS 2,885,253 A * 5/1959 Kesling ..... F25D 25/00 312/247
3,332,637 A 7/1967 Price
(Continued)

FOREIGN PATENT DOCUMENTS

CN 103269618 A 8/2013
CN 205579679 U 9/2016
(Continued)

OTHER PUBLICATIONS

European Office Action regarding Application No. 20708015.1, mailed Mar. 19, 2024.
(Continued)

*Primary Examiner* — Vivek K Shirsat
(74) *Attorney, Agent, or Firm* — Harness, Dickey & Pierce, P.L.C.; Stephen T. Olson

(57) ABSTRACT

A cooking system for a space restricted environment includes at least one cooking unit having at least one cooking hob movable between a stowed position and a deployed position such that in the stowed position the cooking hob is located either behind or below an corre-
(Continued)

sponding surface of a countertop, cabinet, wall or the like and in the deployed position the cooking hob upwardly extends through an opening in the corresponding surface.

12 Claims, 13 Drawing Sheets

(58) Field of Classification Search
USPC ..... 126/9 R
See application file for complete search history.

(56) References Cited

U.S. PATENT DOCUMENTS

| | | | | |
|---|---|---|---|---|
| 5,062,410 | A | 11/1991 | Sarnosky et al. | |
| 7,021,308 | B2 | 4/2006 | Caruso | |
| 8,931,400 | B1 | 1/2015 | Allen | |
| 11,168,893 | B2 * | 11/2021 | Bussotto | F24C 15/2042 |
| 2010/0059040 | A1 * | 3/2010 | Shaffer | F24C 15/2092 126/299 D |
| 2013/0186886 | A1 * | 7/2013 | Leidig | H02J 7/02 219/453.11 |
| 2014/0060394 | A1 | 3/2014 | Yaman et al. | |
| 2022/0163210 | A1 * | 5/2022 | Acosta Herrero | F24C 3/085 |

FOREIGN PATENT DOCUMENTS

| | | | | |
|---|---|---|---|---|
| CN | 205939316 | U | 2/2017 | |
| CN | 206380957 | U | 8/2017 | |
| CN | 107117093 | A | 9/2017 | |
| EP | 2653240 | A1 | 10/2013 | |
| IT | VR20100104 | A1 | 11/2011 | |
| JP | 2012052773 | A | 3/2012 | |
| KR | 20060058846 | A | 6/2006 | |
| WO | WO-2007102649 | A1 * | 9/2007 | A47L 9/26 |

OTHER PUBLICATIONS

International Search Report and Written Opinion of the ISA issued in PCT/IB2020/051436, mailed Jul. 31, 2020; ISA/EP.
Chinese Office Action regarding Application No. 202080016409.6, mailed Nov. 17, 2023.

* cited by examiner

COOKING SYSTEM FOR A SPACE RESTRICTED ENVIRONMENT, A SELF-CONTAINED COOKING UNIT FOR THE COOKING SYSTEM AND RELATED METHOD OF OPERATING A COOKING SYSTEM WITHIN A SPACE RESTRICTED ENVIRONMENT

CROSS-REFERENCE TO RELATED APPLICATIONS

This application is a U.S. National Phase Application under 35 U.S.C. 371 of International Application No. PCT/IB2020/051436, filed 20 Feb. 2020 which claims the benefit of U.S. Patent Application No. 62/811,584 filed 28 Feb. 2019. The entire disclosures of the above applications are herein expressly incorporated by reference.

FIELD

The present disclosure generally relates to a cooking system for a space restricted environment and a self-contained cooking unit for the cooking system. The present disclosure more particularly relates to a space efficient and modular cooking system for vehicles and the like, that can also be used for residential and other applications. The present disclosure also relates to a corresponding method of operating a cooking system within a space restricted environment.

BACKGROUND

The statements in this section merely provide background information related to the present disclosure and may not constitute prior art.

In vehicles such as recreational vehicle or caravans (collectively RVs) and watercraft that provide for a cooking area, space is restricted and as a result the corresponding functionality may be compromised. Space is similarly restricted in watercraft, boats and the like which provide for a cooking area. Explaining further, conventional cooking hobs require a fixed installation that occupies a horizontal space within a vehicle that could otherwise be dedicated to multi-purpose counter space. Such conventional cooking hobs also need specific clearance dimensions in a vertical direction. This increases the dependency on inconvenient cabinet and drawer space that is lower and deeper, particularly in space restricted environments such as presented in RVs, watercraft, and the like.

While known cooking systems for vehicles and like may have proven to be generally successful for their intended purposes, a continuous need for improvement remains in the pertinent art.

SUMMARY

The present teachings are generally related to various aspects of a space efficient and modular cooking system for a vehicle or the like.

It is an object of the present teachings to provide a cooking system for a space restricted environment that includes one or more cooking devices in the form of cooking hobs, air filter units or both cooking hobs and air filter units that may be quickly and easily deployed from a storage area and flexibly used both within and outside the space restricted environment. For example, the cooking devices may be stored below a countertop or behind various other surfaces when not in use.

It is related object of the present teachings to provide a cooking system for a space restricted environment that includes at least one modular cooking unit having a cooking device.

It is another related object of the present teachings to provide a cooking system for a space restricted environment that provides a user with flexibility to create various desired cooking setups for different cooking sessions.

The present teachings particularly provide a cooking system for a space restricted environment including at least one cooking unit having at least one cooking device. As used herein, the term "cooking device" will be understood to mean a cooking hob, an air filter unit or both a cooking hob and an air filter unit. The at least one cooking device is movable between a stowed position and a deployed position such that in the stowed position the cooking device is located either behind, or below, or above an corresponding surface of a countertop, cabinet, wall or the like and in the deployed position the cooking device extends through an opening in the corresponding surface.

The present teachings particularly provide a self-contained cooking unit for a cooking system of a space restricted environment that includes a housing, a lid assembly and a cooking device. The housing includes an open upper end. The lid assembly includes a lid for closing the open upper end of the housing. The lid is moveable between an open position and a closed position. The cooking device is removable from the housing. Additionally, the cooking unit may incorporate an air filter unit that may be removable from the housing or an air filter unit that is integrated within the housing.

The cooking system may also include an elevator. The elevator may be disposed in the housing, for example, for movement between a stowed or lower position and a deployed or upper position. The cooking device may be carried by the elevator such that the cooking device is in a stowed position within the housing when the elevator is in the stowed position and the cooking device is in a deployed position at least partially extending from the housing when the elevator is in the deployed or extended position.

The cooking system may further include a cord retraction mechanism. The cord retraction mechanism may be disposed in the housing, for example, for guiding the cooking device cords in and out of the housing during movement from lower position to an upper position and vice versa. Additional cord guidance is facilitated by the retraction during the removal of the cooking hob or air filter unit from the housing for operation within space restricted environment and vice versa.

The present teachings further provide a method of operating a cooking system within a space restricted environment. The space restricted environment may include a countertop, for example. The method includes providing at least one self-contained cooking unit. Each cooking unit includes a housing, a lid assembly and a cooking device. Each cooking unit may optionally include an elevator and/or a cord retraction mechanism that may be is disposed within the housing. The method additionally includes mounting the self-contained cooking unit to the countertop proximate an opening in the countertop. The method further includes using the elevator to move the cooking device from a stowed position disposed within the housing to a deployed position at least partially extending from the housing. From the deployed position, the cooking device may be removed from the self-contained unit for flexible cooking use on the countertop or remotely therefrom. The method also optionally includes using the cord retraction mechanism to guide the cooking device cords in and out of the housing during deployment, removal from housing, and vice versa where a cord is needed.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

Figure 1:
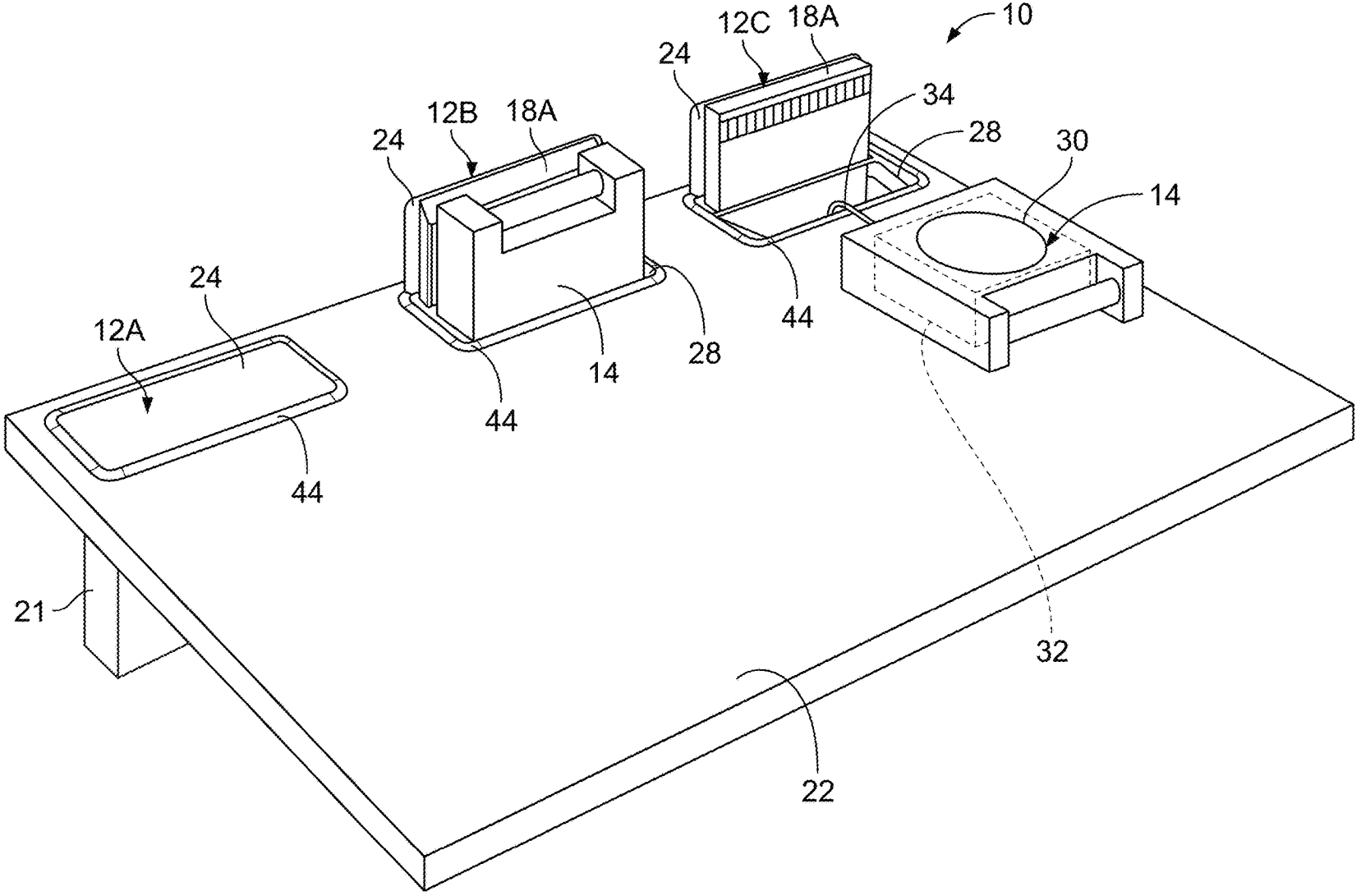
FIG. 1 is a perspective view a cooking system for a space restricted environment in accordance with an exemplary embodiment of the present disclosure, the cooking system shown operatively associated with a countertop and including a plurality of cooking units.

The following description is merely exemplary in nature and is not intended to limit the present disclosure, application, or uses. In this regard, the following description uses specific embodiments that are just examples of particular structure that fall within the scope of the present teachings. For example, while particular cooking units are illustrated in the drawings and described herein, it will be understood that many other cooking units will fall within the scope of the present teachings. It will also be understood that common reference characters have been used throughout the drawings to indicate like or corresponding parts and features.

With initial reference to FIG. 1 of the drawings, a cooking system for a space restricted environment in accordance with an exemplary embodiment of the present disclosure is illustrated and identified at reference character 10 (hereinafter simply the "cooking system 10"). The present teachings are particular adapted for enabling efficient usage and storage within a vehicle such a recreational vehicle ("RV"), caravan, or the like. It will be understood, however, that the present teachings may be readily adapted for other applications such as boats and the like within the present scope. In this regard, and without limitation, the present teachings may be readily extended to other mobile or non-mobile applications.

As particularly shown in the environmental view of FIG. 1, the cooking system 10 may include one or more cooking units 12. In the particular embodiment illustrated, the cooking system 10 includes a plurality of cooking units 12 having a first cooking unit 12A, a second cooking unit 12B, and a third cooking unit 12C. It will be understood, however, a cooking system 10 within the scope of the present teachings may include a greater or lesser number of cooking units 12.

In the embodiment illustrated in FIG. 1, each cooking unit 12 is shown to include a corresponding cooking hob 14 and optionally including a corresponding air filter unit 18A. As will be discussed below in connection with FIGS. 9A through 9G, the optional air filter units 18A may be movable between stowed positions below the countertop 22 and deployed positions at least partially extending through openings 28 in the countertop 22. The air filter units 18A may route air in a conventional manner down and out of the vehicle to vent the air from the vehicle. For certain applications within the scope of the present teachings, the system 10 may only include cooking hobs 14 (i.e., no air filter units 18). In other words, the present teachings may be used in environments incorporating independent air filtering.

Each cooking unit 12 for both cooking system 10 and cooking system 10B will be understood to be a self-contained unit. Explaining further, the cooking units 12 may be packaged and shipped and as self-contained units that may be readily and independently mounted relative to a countertop. Alternative, the components of the cooking units 12 may be connected together (forming different shapes) and sent as one complete solution for single installation. In the embodiment illustrated, the functional components of the cooking unit 12 are housed within the housing 21 during shipping and when the cooking unit 12 is stored within the countertop 22. The housing 21 includes an open upper end and contains all functional components of the cooking unit 12. The upper end of the housing 21 is closed by the lid assembly 20.

As will become better understood below, FIG. 1 illustrates the first cooking unit 12A in first functional position, the second cooking unit 12B in a second functional position and the third cooking unit 12C in a third functional position. The cooking unit 12A may be further operated in a fourth functional position in which the cooking hob 14 is removed from the space restricted environment for remote use. In the first functional position, the cooking hob 14 and the air filter unit 18A of the first cooking unit 12A are stored below a corresponding surface (e.g., the countertop 22), a lid 24 of a lid assembly 20 is articulated to a closed position, and the lid 24 is flush with an upper surface of the countertop 22 such that a corresponding portion of the countertop 22 may be alternatively used. In the second functional position, the lid 24 of the lid assembly 20 is articulated to an open position, while the cooking hob 14 and an air filter housing 26 of the second cooking unit 12B are linearly displaced (e.g., upwardly in the embodiment illustrated) to deployed positions. In this second functional position, the cooking hob 14 and air filter unit 18A partially extends from a corresponding opening 28 in the countertop 22. In the third functional position, the cooking hob 14 of the third cooking unit 12C is placed on the countertop 22 and ready for use.

Another cooking system 10B in accordance with the present teachings will be introduced with reference to FIG. 21 prior to a further description of various detail that may be common to both cooking systems 10 and 10B. As compared to the cooking system 10 of FIG. 1, each cooking unit 12 of the cooking system 10B is shown to only include a cooking device in the form of a cooking hob 14 or in the form of an air filter unit 18A. Explaining further, the second cooking unit 12B and the third cooking unit 12C include cooking hobs 14 and a fourth cooking unit 12D includes an air filter unit 18B. This allows a flexible selection in the number of cooking hobs 14 and air filter units 18B in one cooking system 10B. In order to facilitate this flexibility in a modular manner, cooking hob 14 and air filter unit 18B may be of similar dimensions and/or shape. This allows a common housing 21 to be utilized for either the cooking hob 14 or air filter unit 18B in a cooking unit 12.

Figure 2:
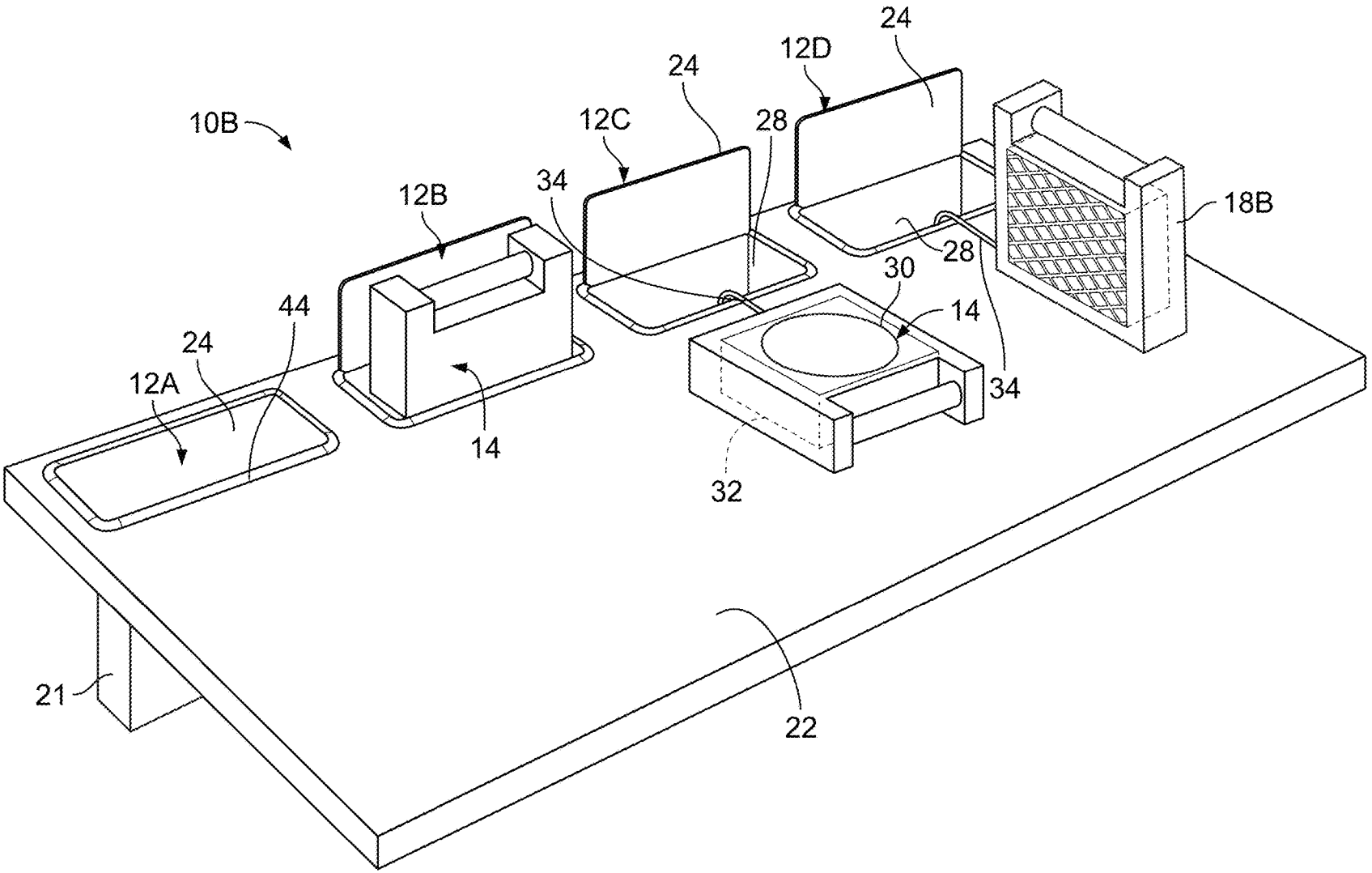
FIG. 2 is a perspective view of another cooking system for a space restricted environment in accordance with an exemplary embodiment of the present disclosure, the cooking system shown operatively associated with a countertop and including a plurality of cooking units.
Figure 3A:
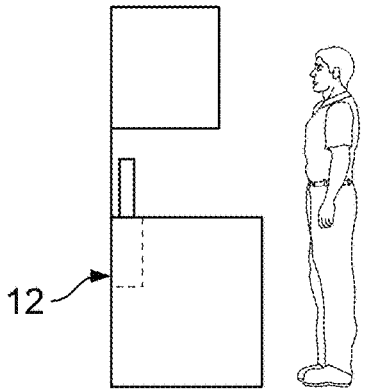
FIG. 3A is a simplified view showing upward, vertical deployment of a cooking device of the present teachings from a stowed position located below a countertop.
Figure 3B:
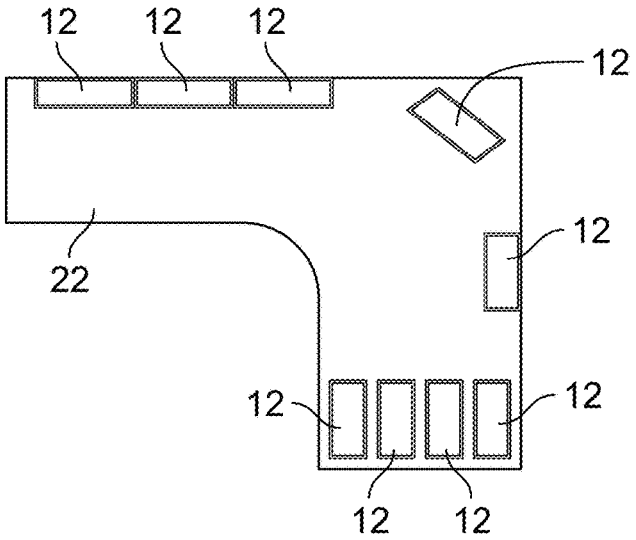
FIG. 3B is a simplified view showing various locations for cooking units on an exemplary countertop.

Before further addressing certain details of the cooking systems 10 and 10B, a description of some common features and advantages will be described. Significantly, and as will be more fully appreciated hereinafter, the cooking units 12 may be located such that otherwise desirable storage area is not consumed by the system 10 or 10B. For example, the cooking units 12 may be located proximate a rear side of the countertop 22 (e.g., proximate a wall of the RV). Such an arrangement is shown in FIG. 1 and FIG. 2 and schematically in FIG. 3A, for example. As such, the vertical space occupied by the cooking units 12 is restricted to a less desirable storage area. In this regard, the cooking units 12 do not impede upon the more convenient cabinet and drawer space located at the forward side of the countertop 22. In FIG. 3B, a simplified view of a countertop 22 incorporating a number of cooking units 12 in various locations is provided. FIG. 3B is illustrative of the flexibility of the system 10 of the present teachings. It will be understood that the cooking units 12 may be located anywhere on the countertop 22.

Figure 3C:
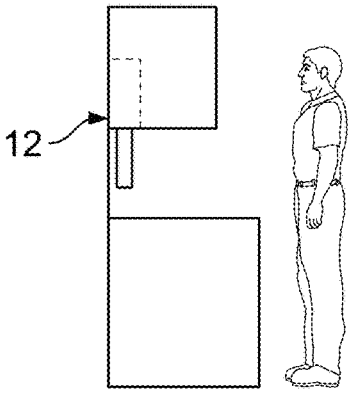
FIG. 3C is a simplified view showing downward, vertical deployment of a cooking device of the present teachings from a stowed position within an upper cabinet.
Figure 3D:
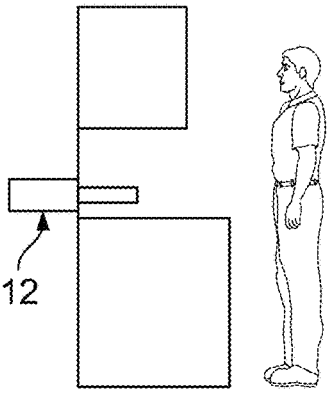
FIG. 3D is a simplified view showing horizontal deployment of a cooking device of the present teachings from a stowed position behind a wall.
Figure 3E:
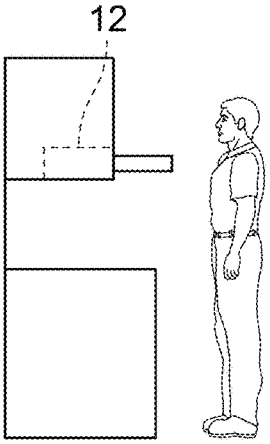
FIG. 3E is a simplified view showing horizontal deployment of a cooking device of the present teachings from a stowed position within an upper cabinet.

In addition to locating the cooking units 12 relative to the countertop 22 as shown in FIGS. 1, 2, 3A and 3B, the cooking units may be located in other convenient areas as desired. For example, FIG. 3C schematically illustrates downward vertical deployment of a cooking unit 12 from a lower side of an upper cabinet. FIG. 3D schematically illustrates horizontal deployment of a cooking until from a wall positioned between an upper cabinet and a lower cabinet. FIG. 3E schematically illustrates horizontal deployment of a cooking unit from a stowed position within an upper cabinet. These and other applications will be understood to be within the scope of the present teachings.

The cooking hobs 14 of cooking systems 10 and 10B will be understood to be similar. The size and configuration of the cooking hobs 14 may be readily adapted for specific uses within the scope of the present teachings. As illustrated, the cooking hobs 14 may include at least one induction heating element 30. While generally illustrated in the drawings to include a single induction heating element 30, the cooking hob 14 may also include two or more induction heating elements 30. The induction heating element 30 may be powered by either a rechargeable battery 32 or through a power cord 34, or by both a rechargeable battery 32 and a power cord 34. The power cord 34 may be a detachable power cord. In other applications, the present teachings may be adapted to include a gas or other powered heating element.

In the first functional position, the power cord 34 is connected to the rechargeable battery 32 for charging of the battery, thereby ensuring a full charge upon cooking hob deployment. As shown in the third function position, the power cord 34 of the third cooking unit 12C may extend from the cooking hob 14, through the opening 28 in the countertop 22 and to a power source (not particularly shown). The power cord 34 may be a self-retracting power cord. Some examples are provided below.

The power cord 34 may serve to both power the cooking hob 14 and recharge the battery 32. The power cord 34 may unplug from the cooking hob 14 such that the cooking hob 14 may be used remotely from rest of the cooking system 10, either within the space restricted environment, or outside the space restricted environment. When the cooking hob 14 is detached, the cooking hob 14 may be powered by an electrical cord, an internal battery, or an external battery. For example, a caravan user may desire to take a charged cooking hob 14 outside the caravan for cooking purposes. It will be understood that other charging means may be used with the present teachings, including but not limited to wireless and docking charging means.

As further detailed in FIGS. 9A through 9G, the cooking units 12 may include a frame 16 having a first frame component 36 and a second frame component 38. The first frame component is an upper frame component 36 proximate an upper end or proximal end of the cooking unit 12. The first frame component 36 may be mounted to an underside of the countertop 22 and may support the components of the lid assembly 20, as will be addressed below. The second frame component is a lower frame component 38 proximate a lower or distal end of the cooking unit 12. A pair of vertically extending guide members 40 extends between the first and second frame components 36 and 38.

Figure 9A:
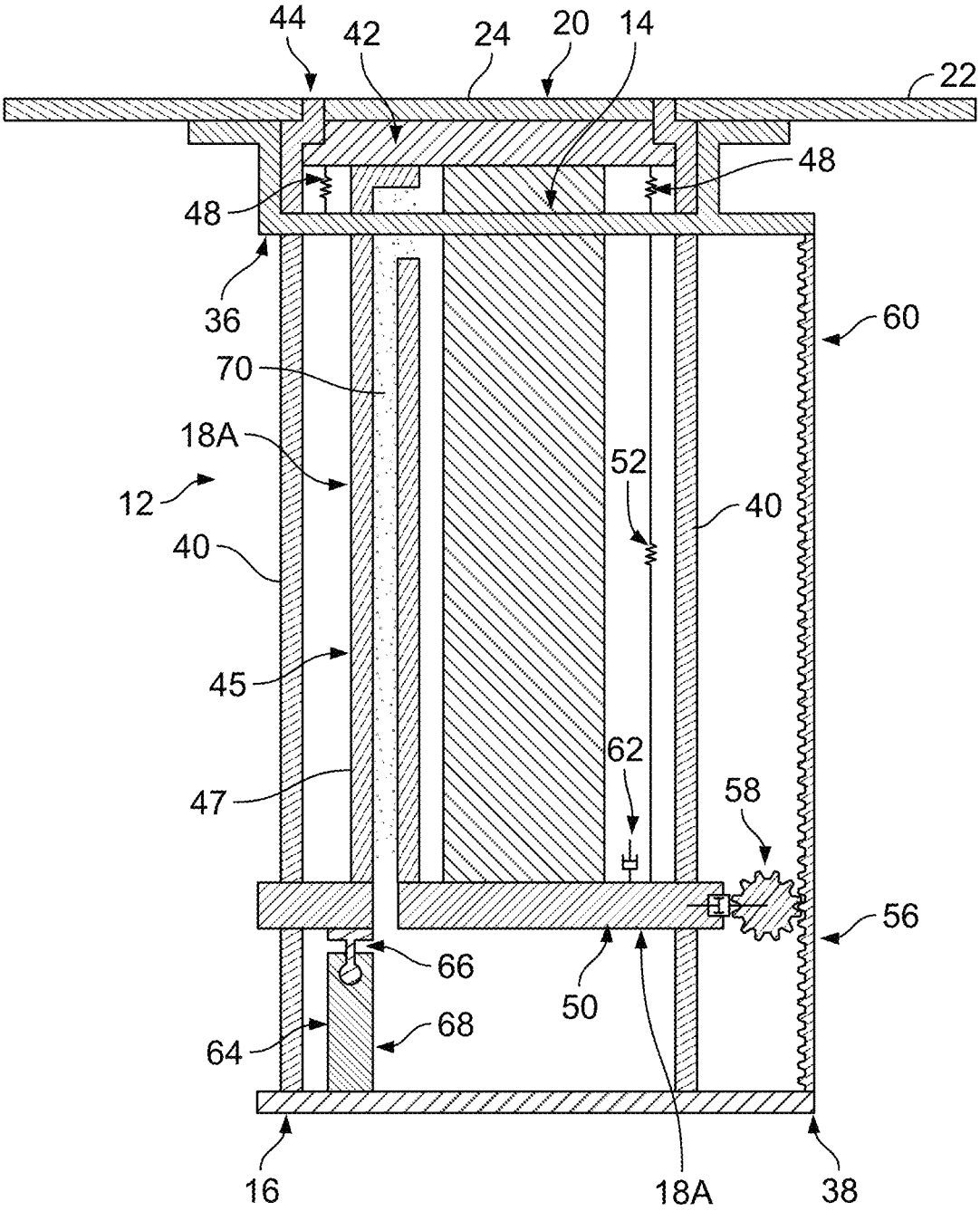
FIG. 9A is a simplified schematic view of one of the cooking units of the cooking system shown in FIG. 1 of the present teachings, an elevator assembly of the cooking unit operates to move the associated cooking device between a stored position and a deployed position shown in the stored position.
Figure 9B:
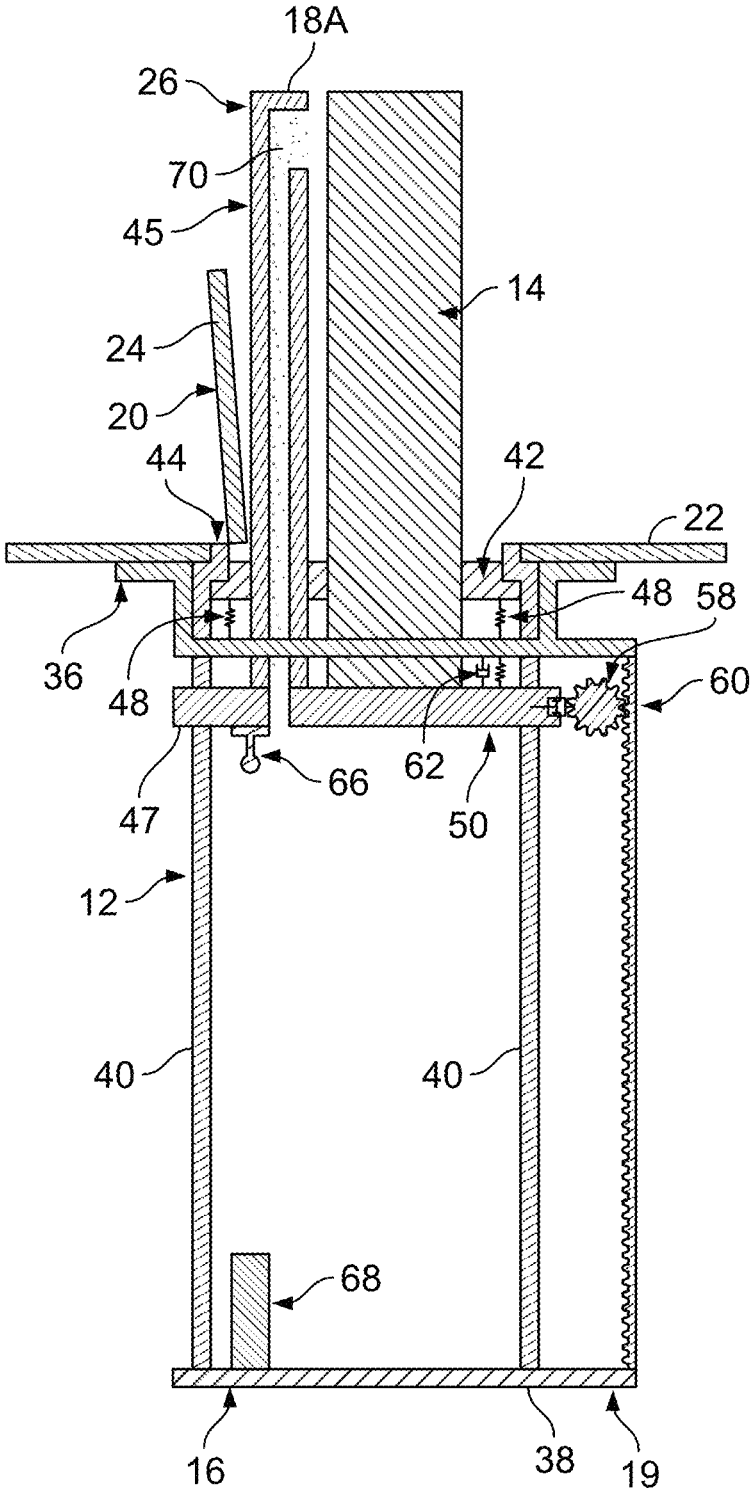
FIG. 9B is a simplified schematic view similar to FIG. 9A, illustrating the elevator assembly in the deployed position.
Figure 9C:
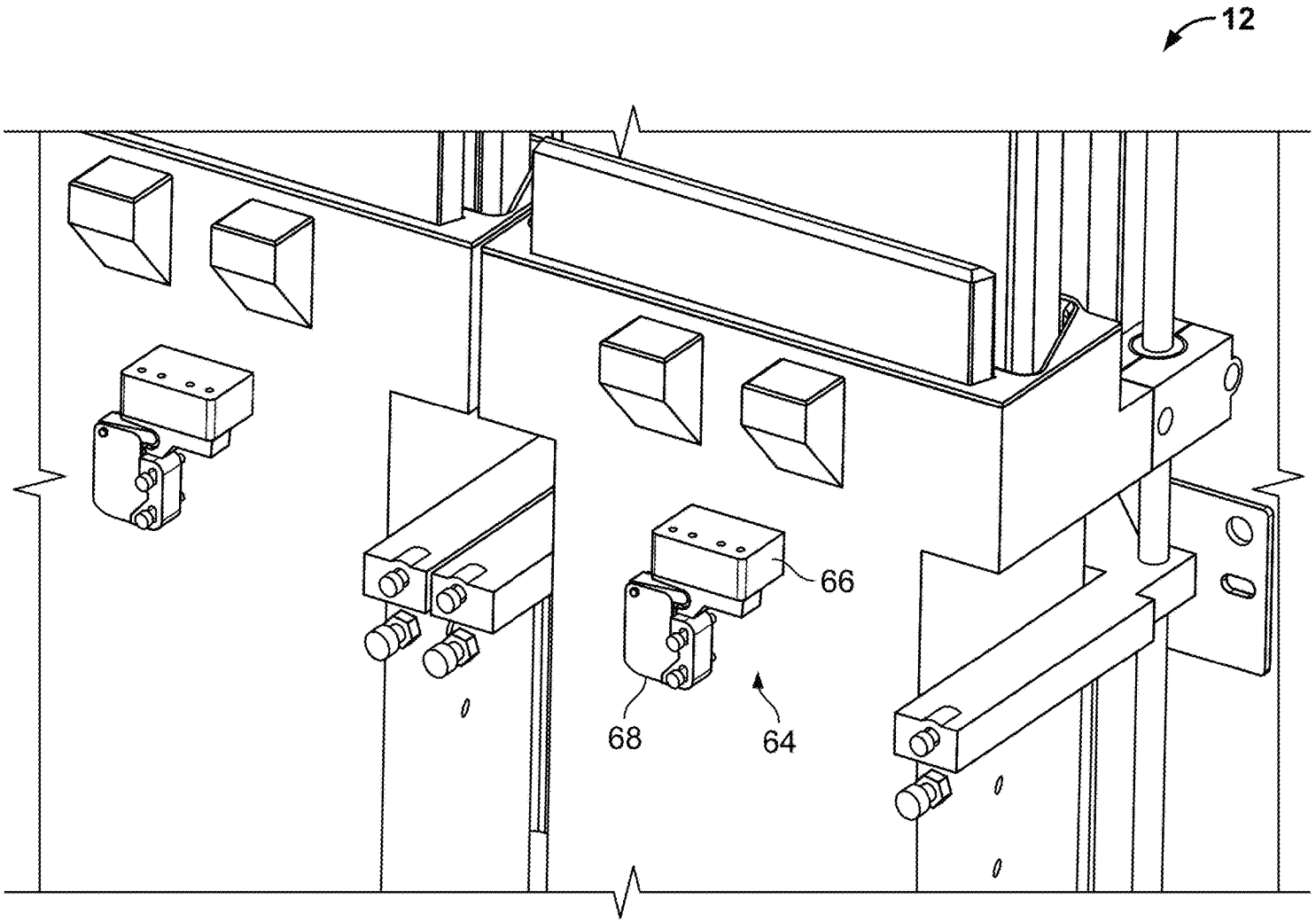
FIG. 9C is a perspective view of a portion of the cooking system in FIG. 1 of the present teachings, further illustrating a retraction mechanism used to selectively retain an associated elevator assembly in the stored position.
Figure 9D:
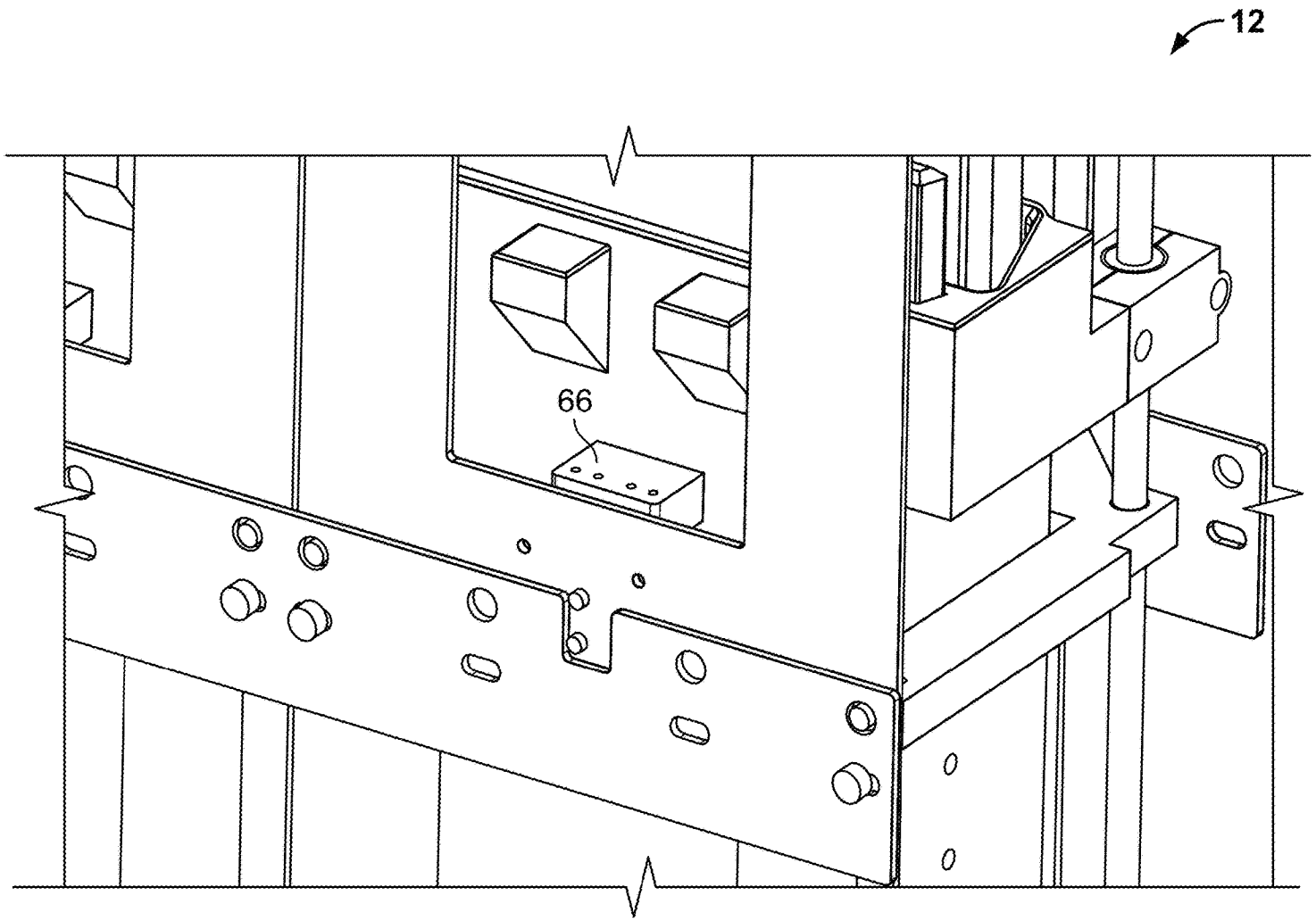
FIG. 9D is another perspective view further illustrating the retraction mechanism of FIG. 9C.
Figure 9E:
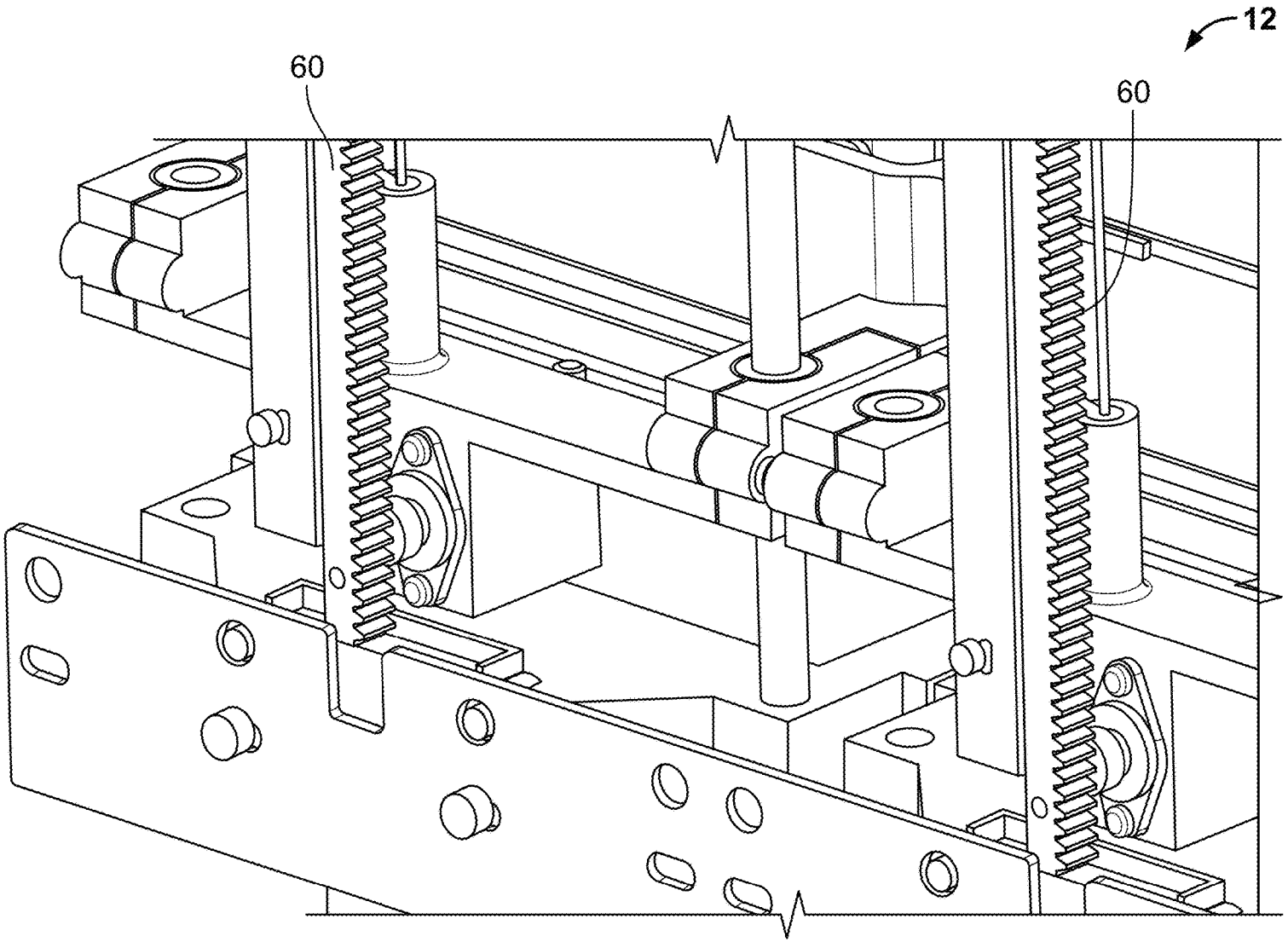
FIG. 9E is a perspective view of a portion of the cooking system in FIG. 1 of the present teachings, further illustrating a rack and pinion arrangement for limiting a deployment speed of an elevator housing of the elevator assembly.
Figure 9F:
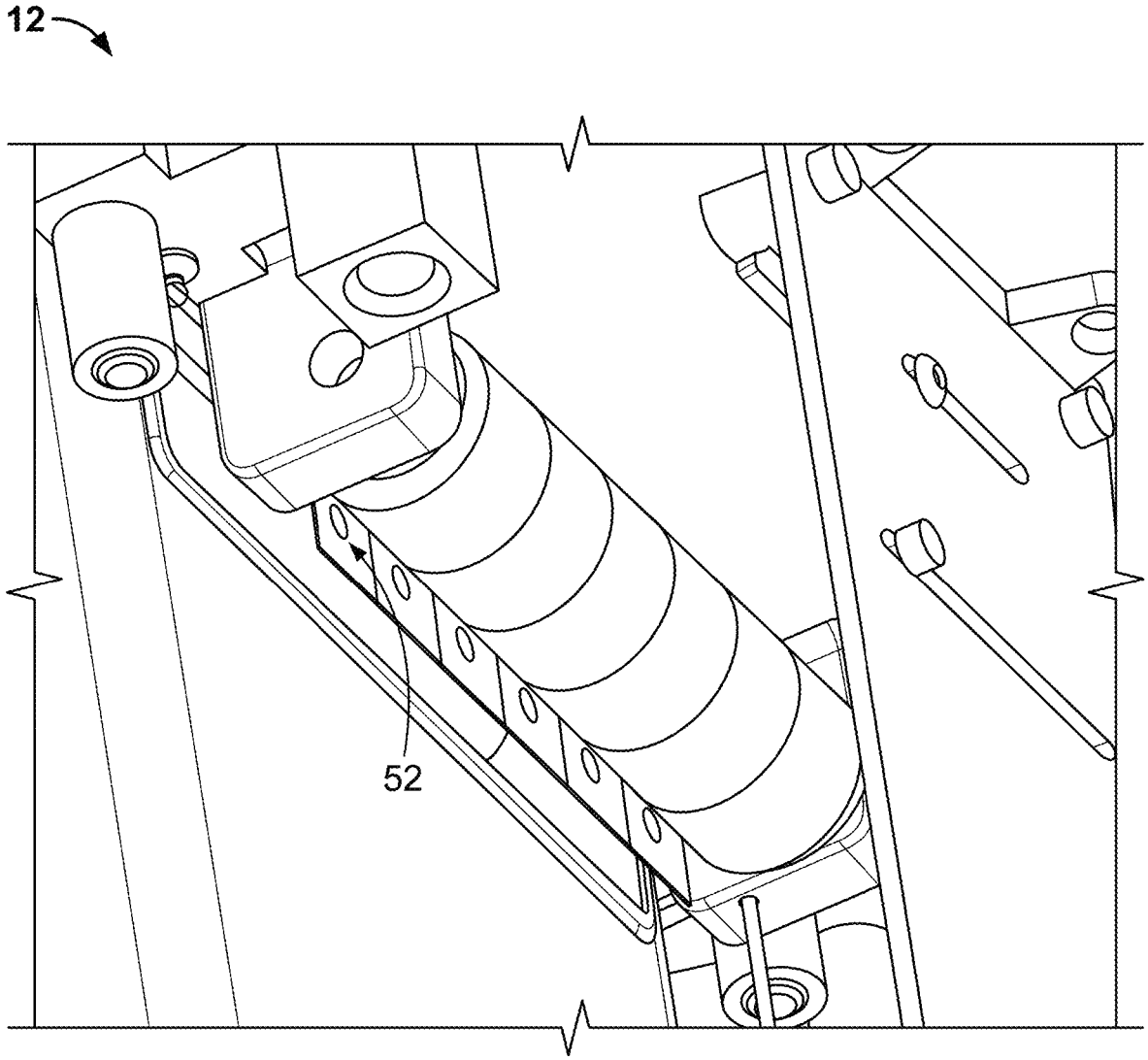
FIG. 9F is a perspective view of a portion of the cooking system in FIG. 1 of the present teachings, further illustrating a biasing mechanism for biasing the elevator housing to the deployed position, the biasing mechanism including a plurality of constant force springs.
Figure 9G:
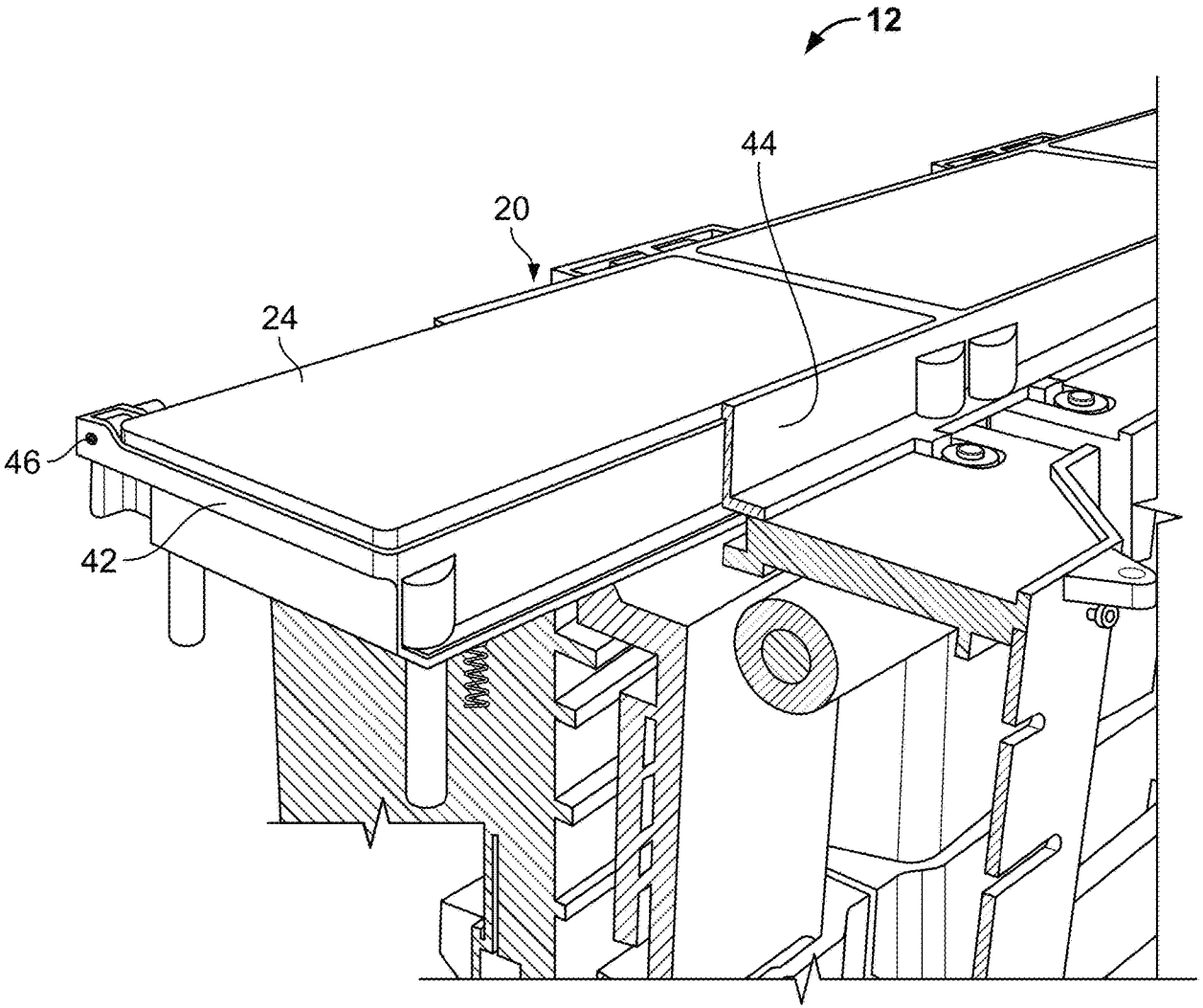
FIG. 9G is a partially cut-away perspective view of a portion of the cooking system in FIG. 1 of the present teachings, further illustrating a lid assembly and related components, a lid of the lid assembly shown in a closed position.

The lid assembly 20 includes the lid 24, a lid assembly frame 42 and a cosmetic trim member 44. The lid 24 is coupled to the lid assembly frame 42 for articulation between an open position and a closed position about a pivot axis 46. The open position is shown in FIG. 9B for example. The closed position in shown in FIGS. 9A and 9G, for example.

The cosmetic trim member 44 upwardly extends through the hole 28 in the countertop 22 to a position flush with an upper surface of the countertop 22. The upper surface of the countertop 22, the upper surface of the lid 24 and the uppermost surface of the cosmetic trim member 44 are generally within the same common horizontal plane. As noted above, such a relationship allows for a corresponding portion of the countertop 22 to be alternatively used when the hob 14 is stored. One or more springs 48 may upwardly bias the lid assembly frame 42 relative to the first frame component 36.

The elevator and air filter unit assembly 45 may include an elevator 47 and an air filter unit 18A. The elevator 47 is operative for moving the hob 14 between the stowed position and the deployed position. Explaining further, the elevator 47 includes an elevator frame 50 moveable between corresponding stowed and deployed positions. It will be understood that the shape, size and other characteristics of the elevator frame 50 may be readily adapted within the scope of the present teachings provided that the general function is retained. The stowed position is shown in FIG. 9A for example. The deployed position of the elevator frame 50 is shown in FIG. 9B, for example. In the stowed position, the hob 14 and air filter unit 18A are completely recessed below the upper surface of the countertop 22. In the deployed position, the hob 14 and air filter unit 18A partially extend above the countertop 22. Vertical movement of the elevator 47 between the stowed position and the deployed position is guided by the vertically extending guide members 40.

Movement of the elevator frame 50 from the stowed position to the deployed position may be provided by a biasing mechanism 52. In one particular form, the biasing mechanism may include a plurality of constant-force springs 52. As will be addressed in detail below, may be used within the scope of the present teachings to move the elevator frame between the stowed and deployed positions.

The speed at which the elevator frame 50 moves may be regulated by a speed control mechanism 54. The speed control mechanism 54 may include a rack and pinion arrangement 56 having a rotational damper 58 in the form of a pinion and a cooperating rack 60. The rack 60 may extend between the first and second frame components 36 and 38.

A linear damper 62 is carried by the elevator frame 50. The linear damper 62 engages a lower side of the first frame component 36 as the elevator frame 50 approaches its deployed position. Such engagement provides a smooth stop of the elevator and air filter unit 45.

The cooking unit 12 further includes a push-push activated retraction mechanism 64. It will be understood that the particular type of retraction member is beyond the scope of the present teachings. In this regard, other retraction mechanism may be readily incorporated, including but not limited to an electronic button, a touch button, a movement sensor, a light sensor and a sound sensor. In the particular embodiment illustrated, the retraction mechanism 64 includes a first component or retraction mechanism capture geometry 66 and a second component or retraction mechanism 68. The first component 66 may be carried by the elevator frame 50. The second component 68 may be carried by the second frame component 38.

The air filter unit housing 26 of the air filter unit 18A may include a filter 70. The air filter unit housing 26 functions to purify the space restricted environment of odors. The air filter unit housing 26 defines a vent path containing the filter 70. The vent path fluidly communicates an upper end of the air filter unit housing 26 with an area below the elevator frame 50. In this manner, odors can be withdrawn from the space restricted environment and expelled from the vehicle, for example, in a known manner. The air filter unit 18A is carried by the elevator frame 50 such that the air filter unit correspondingly moves between stowed and deployed positions. It will be understood that the cooking unit 12 of the present invention may be adapted such that it does not include an air filter unit 18A.

With particular reference to FIGS. 1 and 9A-9G the drawings, operation of one of the cooking units 12 of cooking system 10 of the present teachings will be further described. With the cooking unit 12 in its stowed position, (as represented in FIG. 1 by the first cooking unit 12A), the user initiates deployment of the elevator and air filter unit assembly 45 by pressing down on the lid 24. Downward movement of the lid 24 correspondingly downwardly displaces the elevator and air filter unit assembly 45, including the elevator frame 50. As a result, the push-push release mechanism 64 releases the elevator and air filter unit assembly 45 from the stowed position. The constant-force springs 52 of the biasing mechanism 52 now moves the constant-force springs 52 upwardly. The speed of movement is regulated by the speed control mechanism 54. The elevator and air filter unit 45 continues to the deployed position, as shown in FIG. 9B, for example. In this position, the cooking hob 14 may be removed by the user for use on the countertop 22 or remotely. After such use, the hob 14 is returned to the elevator and air filter unit 45. When the elevator and air filter unit 45 is pressed down by the user, the components of the push-push release mechanism 64 engage to retain the elevator and air filter unit assembly 45 in the stowed position.

With reference to FIGS. 2, 4A, 4B and 5-6, the system 10B will be further described. In addition to the cooking device (e.g., either a cooking hob 14 or an air filter unit 18B), it will be understood that each of the cooking units 12A-12D generally includes a housing 21, an elevator 202, a cord retraction mechanism 300 and a lid assembly 20. As above, each cooking unit 10B will continue to be understood to be a self-contained unit and it will also be understood that a greater or lesser number of cooking units 12 may be incorporated within the scope of the present teachings.

Figure 4A:
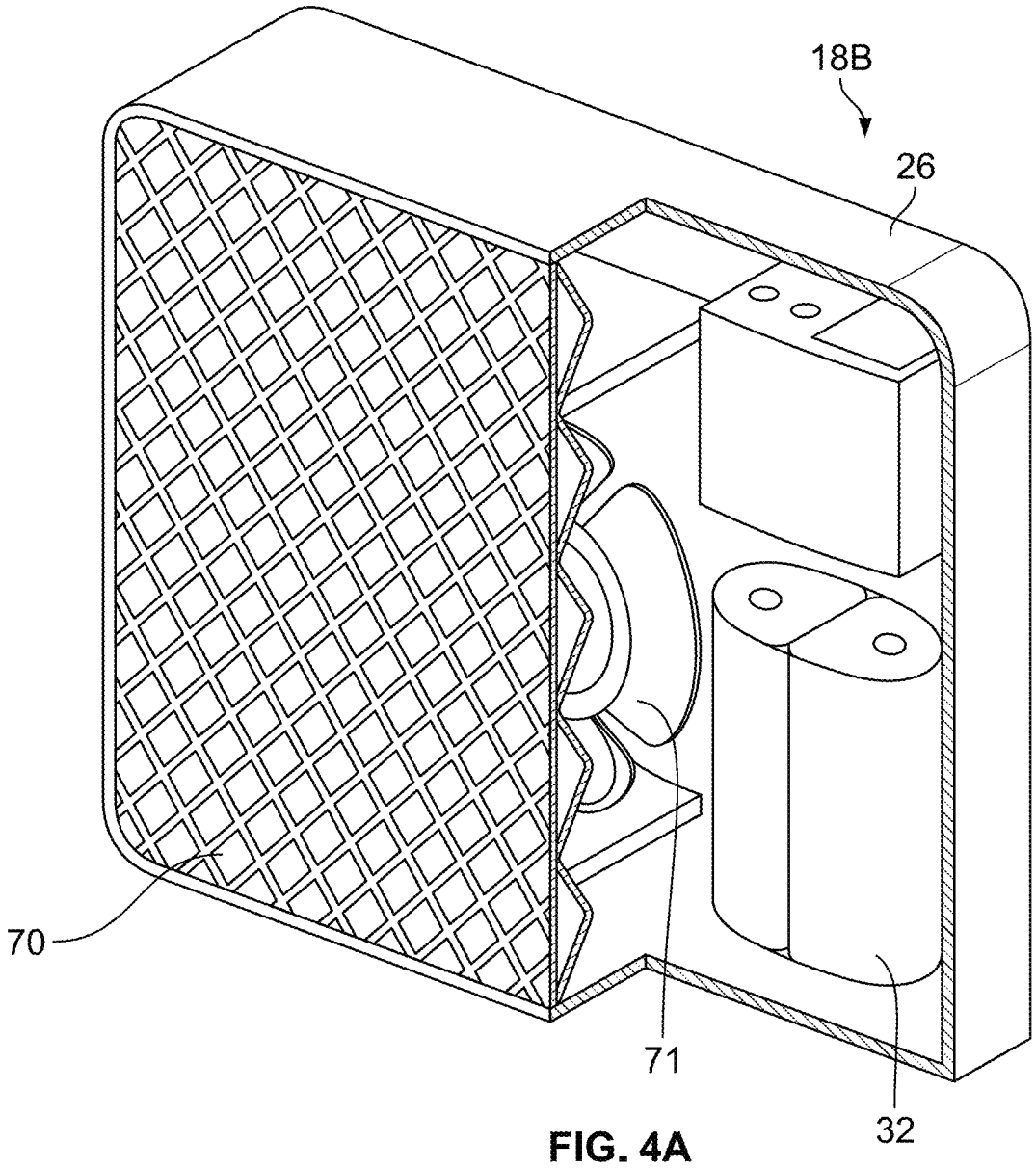
FIG. 4A is a partially cut-way perspective view of a self-contained air filter unit which can be utilized on its own within the alternative cooking unit method of FIG. 4 in accordance with the present teachings.
Figure 4B:
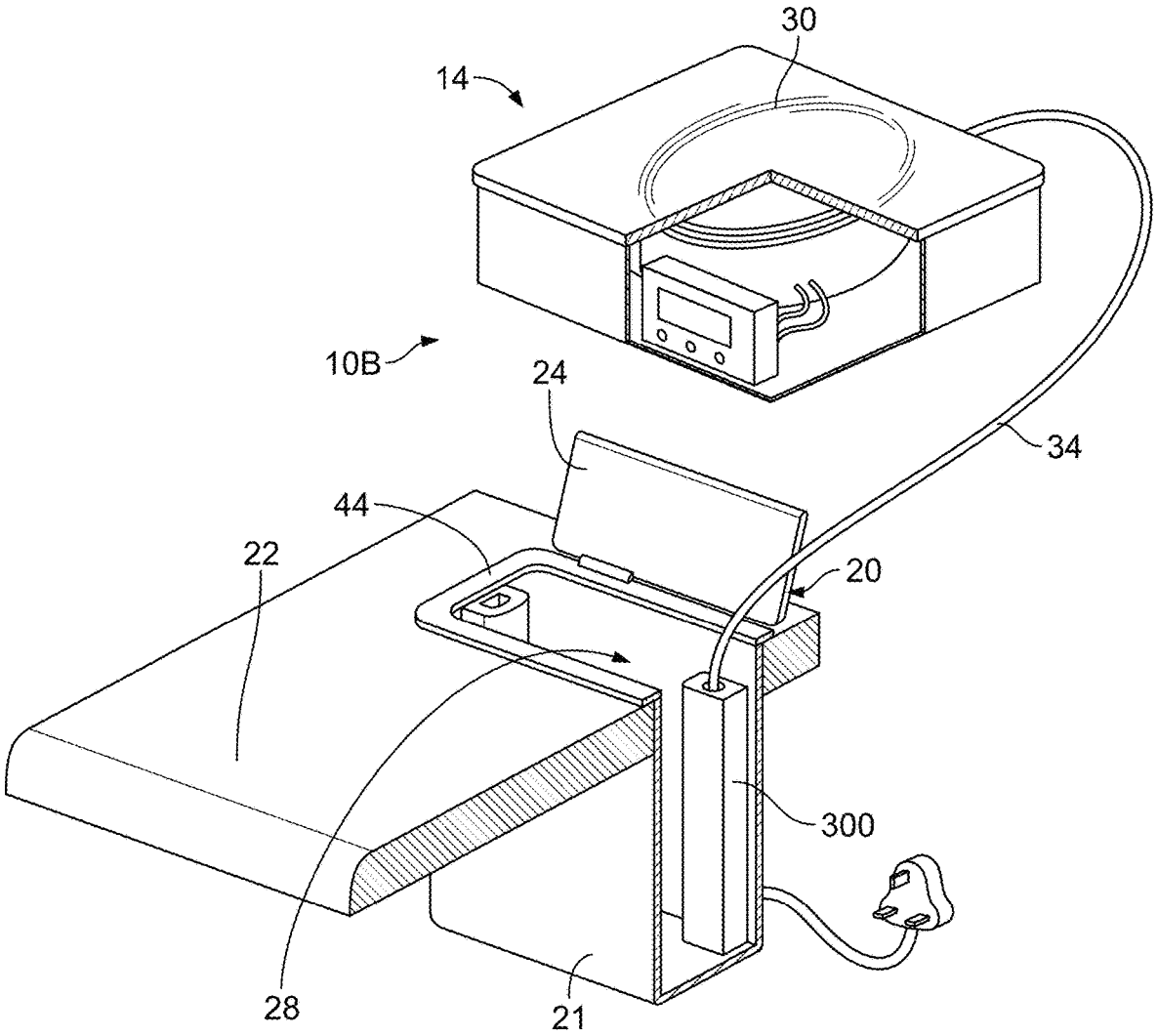
FIG. 4B is a partially cut-away perspective view illustrating an alternative cooking unit of FIG. 2 in accordance with the present teachings, a housing of the cooking unit shown operatively associated with countertop.
Figure 5:
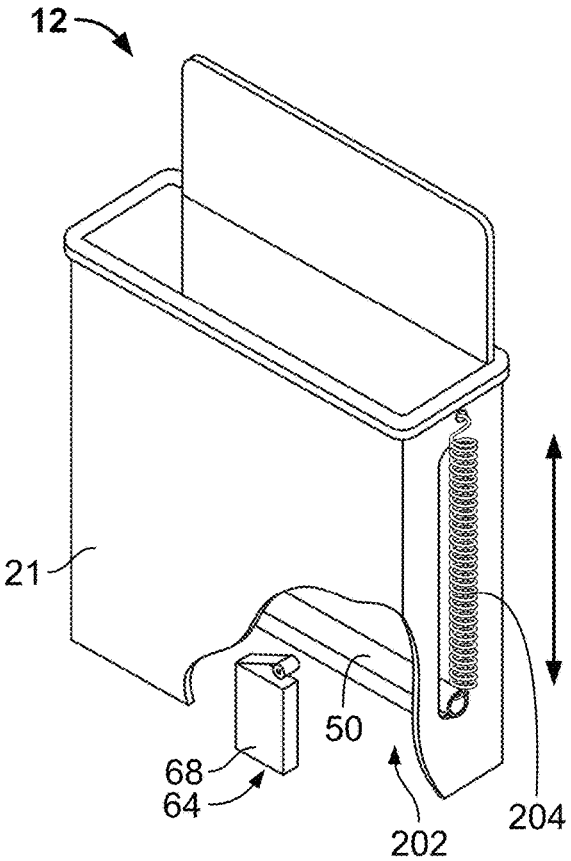
FIG. 5 is a partially cut-away perspective view of one of the cooking units of the system of FIG. 2, further illustrating an integrated elevator mechanism, the elevator mechanism including a retraction mechanism used to selectively retain an associated elevator mechanism in the stored position.

With particular reference to FIG. 4A, the air filter unit 18B for cooking units 12 of the system 10B differs from that for cooking units 12 of the system 10 by recycling air rather than venting it out of the space restricted environment and expelling it from the vehicle. In air filter unit 18B of cooking units 12 of the system 10B, the air filter unit housing 26 functions to purify the space restricted environment of odors. Small differences may be noted between the air filter unit 18B shown in FIG. 2 and the air filter unit shown in FIG. 4A. For example, the handle of FIG. 2 is not shown in FIG. 4A. These differences, however, simply reflect two exemplary embodiments consistent with the present teachings.

The air filter unit 18B in cooking system 10B of the present teachings may include at least one fan 71 disposed in the housing 26. While generally illustrated in the drawings to include a single fan 71 and single filter 70, the air filter unit 18B may also include two or more fans 71 and/or filters 70. The fan 71 may be powered by either a rechargeable battery 32 or through a power cord 34, or by both a rechargeable battery 32 and a power cord 34. The air filter unit 18B operates by forcing air through the filter 70 by means of the fan 71. The filtered air is then expelled from an opening (not particularly shown) in the air filter unit 18B, back into the space restricted environment. In this manner, the space restricted environment can be purified from odors.

Similar to the functional positions of the cooking devices discussed above with respect to the system 10, the cooking hob 14 and the air filter unit 18B of the system 10B may both operate in first, second, third and fourth functional positions.

In the first functional position, the power cord 34 is connected to the rechargeable battery 32 for charging of the battery, thereby ensuring a full charge upon air filter unit deployment. As shown in the fourth function position, the power cord 34 of the fourth cooking unit 12D may extend from the air filter unit 18B, through the opening 28 in the countertop 22 and to a power source (not particularly shown). The power cord 34 may be a self-retracting power cord. Some examples are provided below.

The power cord 34 may serve to both power the air filter unit 18B and recharge the battery 32. The power cord 34 may unplug from the air filter unit 18B such that the air filter unit 18B may be used remotely from rest of the cooking system 10. When the air filter unit 18B is detached, the air filter unit 18B may be powered by an electrical cord, an internal battery, or an external battery. For example, a caravan user may desire to take a charged air filter unit 18B away from the cooking system 10 and to the dining area of the caravan for odor purification purposes. It will be understood that other charging means may be used with the present teachings, including but not limited to wireless and docking charging means.

With reference to FIGS. 2 and 4-8 the drawings, one cooking unit 12 of the cooking system 10B will be further described. With the cooking unit 12 in its stowed position, (as represented in FIG. 2 by the first cooking unit 12A), the user initiates deployment of the elevator assembly 202 by pressing down on the lid 24. Downward movement of the lid 24 correspondingly downwardly displaces the stored cooking hob 14 or air filter unit 18B. As a result, the push-push release mechanism 64 is activated so that the retraction mechanism 68 releases the retraction mechanism capture geometry 66 (in the cooking units 12 of the system 10B, this is embedded within the cooking hob 14 and the air filter unit 18B body which is not necessarily shown in the figures), hence, releasing the elevator assembly 202 from the stowed position.

The elevator assembly 202 includes a biasing mechanism in the form of extension springs 204 which normally bias the associated cooking device to the deployed position. The cooking device sits on the elevator frame 50. Upon releasing the retraction mechanism 68, the extension springs advance the elevator assembly 202 to the deployed position. During the deployment of the elevator assembly 202, the cord retraction mechanism 300 start its engagement. In this regard, an elastic member 302 of the cord retraction mechanism 300 may be employed. The cooking hob 14 or air filter unit 18B may be removed by the user for use on the countertop 22 or remotely. After such use, the cooking hob 14 or air filter unit 18B is returned to the elevator assembly 202. When the elevator assembly 202 is pressed down by the user, extension springs 204 are moved downwardly and the components of the push-push release mechanism 64 engage to retain the elevator assembly 202 in the stowed position. During the removal of the cooking hob 14 or the air filter unit 18B, the cord retraction mechanism 300 is engaged to ensure no excess cord is present on the countertop 22 during use within the restricted environment. Furthermore, the retraction mechanism 300 engagement ensures that no excess cord is present in the cooking unit 10B housing 21 both during removal and placement of cooking hob 14 or air filter unit 18B, hence, smooth operation of the elevator assembly 202 is allowed. Once the elevator assembly 202 is in stowed position again, the cord retraction mechanism 300 is disengaged.

Figure 6:
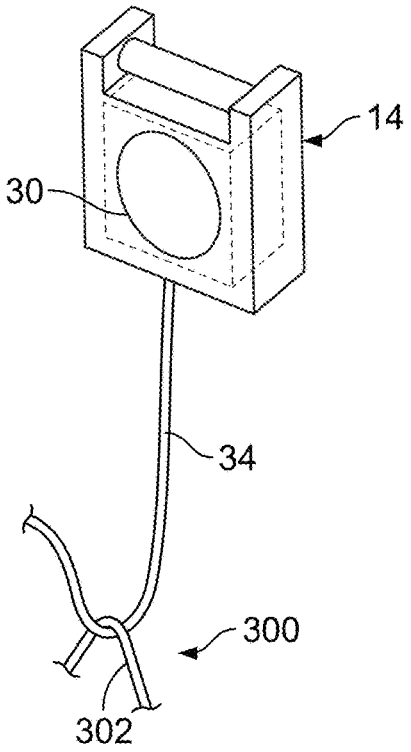
FIG. 6 is a perspective view of a cord retraction mechanism in accordance with the present teachings.
Figure 7:
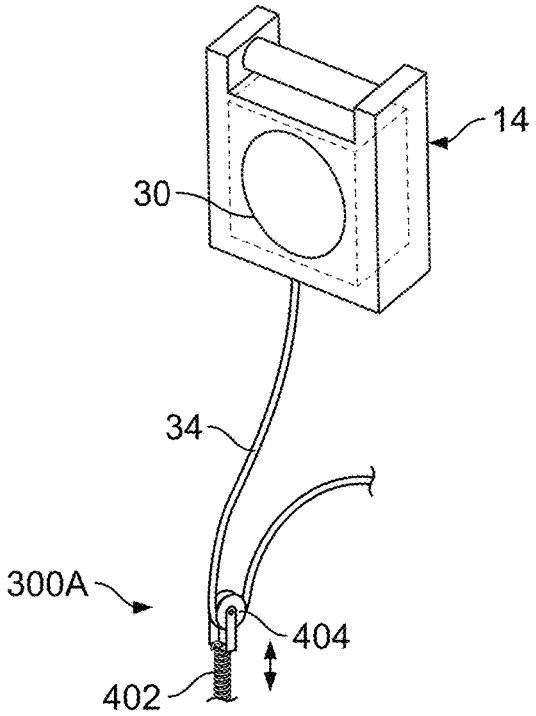
FIG. 7 is a perspective view of another cord retraction mechanism in accordance with the present teachings.
Figure 8:
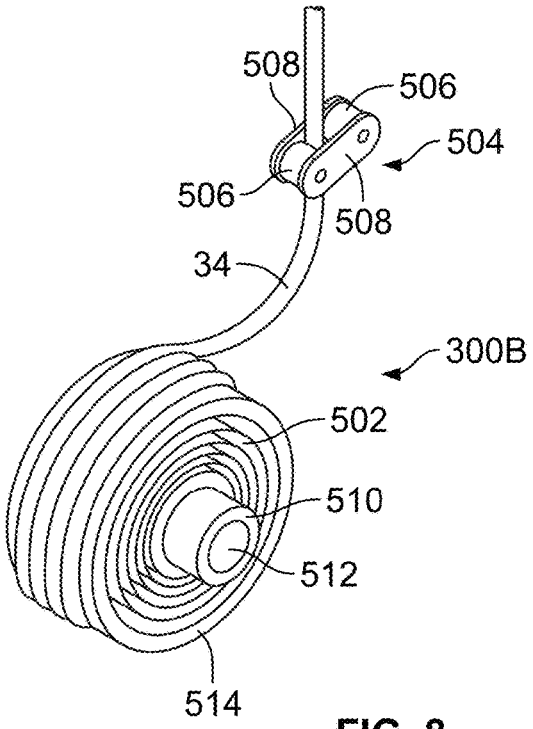
FIG. 8 is a perspective view of another cord retraction mechanism in accordance with the present teachings.

With reference to FIGS. 6 through 8, the various cord retraction mechanism in accordance with the present teachings, including the cord retraction mechanism 300 introduced above are illustrated. The first cord retraction mechanism 300 of FIG. 6 includes a tensioning element in the form of the elastic member 302. The second cord retraction mechanism 300A of FIG. 7 includes a tensioning element in the form of an extension spring 402. The extension spring 402 may be connected to a guide wheel 404 for guiding the cord 34. The third cord retraction mechanism 300B of FIG. 8 includes a tensioning element in the form of a flat metal spring 502. The cord 34 may be guided by a guide mechanism 504 including a pair of guide wheels 506 connected by a pair of plates 508. The flat metal spring 502 may be wound around a central spigot or hub 510. A channel 512 defined by the spigot 510 may provide a cable connection point for power. A drum 514 circumferentially surrounds the wound spring 502.

It will now be appreciated that the cooking systems 10 and 10B of the present teachings both provide an arrangement particularly adapted for storage and flexibility of use within a restricted space environment. The cooking systems 10 and 10B of the present teachings also provides a rechargeable hob 14 that can be taken outside the flexible use environment of the vehicle for remote use. As noted elsewhere, outside the space restricted environment, the cooking hob 14 may be powered by an electrical cord, an internal battery or an external battery.

It will also be understood that the scope of the present teachings does not require an elevator mechanism. In this regard, the cooking hob 14 may simply be manually removed from the housing 21. It will still also be understood that various other elevator mechanisms may be used in connection with the teachings of the present invention. In this regard, any other elevator mechanism known in the art or developed hereafter may be employed with present teachings.

While various aspects have been described, those skilled in the art will recognize modifications or variations which might be made without departing from the present disclosure. The examples illustrate the various embodiments and are not intended to limit the present disclosure. For example, while the various inventions described herein may have particular application for recreational vehicles, the present teachings may be readily adapted for other vehicles, including but not limited to those in the marine industry. Therefore, the description and claims should be interpreted liberally with only such limitation as is necessary in view of the pertinent prior art.

What is claimed is:

1. A cooking system for a space restricted environment, the cooking system comprising:

at least one cooking device movable between a stowed position and a deployed position such that in the stowed position the cooking device is located below a corresponding surface of a countertop, and in the deployed position the cooking device upwardly extends through an opening in the corresponding surface, the at least one cooking device selected from a group consisting of a cooking hob, an air filter unit and a combination thereof, and a lid assembly having a lid moveable between an open position and a closed position about a pivot axis, the lid closing the opening in the corresponding surface and substantially flush with the upper surface of the corresponding surface when in the closed position, wherein the cooking device is removable from the deployed position for random placement on the countertop to provide cooking setup flexibility, and wherein the lid closes the opening in the corresponding surface when the cooking devices is removed from the deployed position for random placement.

2. The cooking system for a restricted environment of claim 1, wherein the cooking device is movable between the stowed position and the deployed position in a vertically upward direction and a vertically downward direction.

3. The cooking system for a space restricted environment of claim 1, further comprising an elevator operative to move the cooking device between the stowed position and the deployed position and a cord retraction mechanism for guiding one or more cooking device cords.

4. The cooking system for a space restricted environment of claim 1, wherein the device is a cooking hob including an induction cooking element.

5. The cooking system for a space restricted environment of claim 1, wherein the cooking device is powered by an electrical cord, and further Wherein the electric cord is detachable for remote use of the cooking device.

6. The cooking system for a space restricted environment of claim 1, wherein the cooking device is powered by a battery selected from a group consisting of an internal battery and an external battery.

7. The cooking system for a space restricted environment of claim 1, wherein each cooking unit of the at least one cooking unit defines a self-contained unit for ready and independent mounting relative to the corresponding surface.

8. The cooking system for a space restricted environment of claim 1, wherein the lid assembly further includes a cosmetic trim member upwardly extending through a hole in the corresponding surface to a position flush with the corresponding surface.

9. The cooking system for a space restricted environment of claim 8, wherein the corresponding surface, the upper surface of the lid and an uppermost surface of the cosmetic trim member are generally within a common horizontal plane.

10. The cooking system for a space restricted environment of claim 3, wherein the elevator includes an elevator frame moveable from the stowed position to the deployed position by a biasing mechanism.

11. The cooking system for a space restricted environment of claim 1, wherein the corresponding surface is the countertop and the cooking system further includes the countertop.

12. The cooking system for a space restricted environment of claim 1, wherein each cooking unit is mounted relative to the corresponding surface proximate a hidden side of the corresponding surface.

* * * * *